United States Patent [19]

Backlund et al.

[11] 3,952,080

[45] Apr. 20, 1976

[54] SOLIDIFICATION OF A MOLTEN SURFACTANT SOLUTION

[75] Inventors: Gerald Richard Backlund, Maplewood, N.J.; Yakow Breslerman, Pearl River, N.Y.

[73] Assignee: American Cyanamid Company, Stamford, Conn.

[22] Filed: Feb. 10, 1975

[21] Appl. No.: 548,854

Related U.S. Application Data

[63] Continuation of Ser. No. 381,129, July 20, 1973, abandoned.

[52] U.S. Cl. ..... 264/176 F; 264/143

[51] Int. Cl.[2] ..... C11D 3/22

[58] Field of Search ..... 264/143, 176 F

[56] References Cited

UNITED STATES PATENTS

| | | | |
|---|---|---|---|
| 1,164,397 | 12/1915 | Richardson | 264/176 R |
| 1,779,301 | 10/1930 | Welter | 264/143 |
| 2,343,829 | 3/1944 | Claytor | 264/143 |
| 3,803,285 | 4/1974 | Jensen | 264/143 |

*Primary Examiner*—Jay H. Woo
*Attorney, Agent, or Firm*—Gordon L. Hart

[57] ABSTRACT

A process for cooling sodium dicyclohexyl sulfosuccinate product mixture which consistently produces solid, non-tacky particles suitable for dry packaging. The product is cooled from melt to viscous semi-solid state in a scraped surface heat exchanger then extruded to strands which are further cooled in air to ambient temperature.

1 Claim, No Drawings

SOLIDIFICATION OF A MOLTEN SURFACTANT SOLUTION

This is a continuation of copending application Ser. No. 381,129, filed July 20, 1973, and now abandoned.

The invention relates to preparation of surfactant composition in a solid particulate form adaptable for dry packaging prior to use.

Sodium dicyclohexyl sulfosuccinate is an anionic surfactant suitable for use in various surfactant applications. It is prepared by the sulfonation of dicyclohexyl maleate at about 175°–200°F.

As the product is taken from the sulfonation reactor, the molten product consists of about 80–82% by wt. of sodium dicyclohexyl sulfosuccinate, about 13–16% by wt. of volatiles (e.g. water) and about 3 to 6% by wt. of several inorganic salts and hydrolysis product. This product mixture, when properly cooled, will form a rigid friable solid, but unless it is properly cooled it will remain soft and tacky on cooling, making the product quite difficult to handle. Ordinary unit operations for cooling the product, such as by means of a drum flaker or belt cooler were found to be unsuitable because the results were erratic, often producing the tacky soft material that is unsuitable for packaging.

According to the invention, it has been discovered that a uniformly rigid, friable, non-tacky solid product is obtained by several steps, the first of which is partially cooling the molten surfactant product from melt temperature usually above 175°F. to a lower intermediate temperature at which the product attains a thickened plastic consistency. This partial cooling step is carried out with constant mixing, preferably by means of a scraped surface heat exchanger. The partially cooled material will usually reach the desired plastic consistency at about 145°–165°F. At this consistency, the material is extruded to make circular strands of the material having about ⅛ to about ¼ inch diameter, or to make other suitable shape and size strands. These strands, which retain their shape after extrusion, are further cooled and solidified by contact with air, preferably on a conveyor belt, until the strands have become rigid and friable at ambient temperature. Finally, the cooled non-tacky solid strands are broken into particles of size suitable for packaging as in bags, drums or the like.

Probably, the initial cooling step which provides excellent agitation and considerable residence time in the mixer as the mass is cooled to plastic consistency, promotes a more uniform initiation of crystallization in the product, so that upon further cooling, such crystallization will continue uniformly in the mass to produce the excellent non-tacky solid particles instead of a tacky soft product.

A preferred mode for carrying out the invention is described in the following detailed example. Modifications and variations from the exact detail of this example can be made within the scope of the invention.

EXAMPLE 1

A water-jacketed, scraped-surface heat exchanger is fitted at its outlet with a cylindrical holding chamber which is followed by an extrusion nozzle and extrusion plate. Cooling water is circulated in the cooling jacket of the heat exchanger. Molten sodium dicyclohexyl sulfosuccinate product mixture, of composition within the ranges described above, is fed into the cooling chamber of the heat exchanger by means of a positive displacement pump which delivers sufficient force to provide the pressure needed for extrusion of the product through the extrusion plate at the opposite end. The liquid to be cooled is continuously mixed and agitated as it passes through the heat exchanger by means of interior paddle blades which continuously scrape the inner walls of the exchanger and mix the solids formed at the cooled walls into the mass of material. The liquid surfactant enters the heat exchanger in molten state, preferably at about 185°–190°F. and leaves through the extruder plate at about 145°–165°F. Feed rates of the coolant and surfactant are adjusted as necessary to attain the desired cooling to maintain inlet and outlet temperatures in those ranges. Furthermore, the feed rate of the surfactant product must be adjusted to provide continuous extrusion at a rate that will produce the desired continuous, self-supporting extruded strands. All of these adjustments of variable rates will depend upon the individual characteristics of the cooling and extruding apparatus used. It is most desirable to select a cooling apparatus having a cooling chamber large enough and with mixing means sufficient for thorough mixing of the surfactant in the chamber as the temperature is reduced. A holding chamber is preferably provided at the outlet of the cooling chamber through which the material passes before entering the extruder. This is provided to allow a few minutes for crystallization to progress in the cooled mass at the reduced temperature, before the extrusion step. Some heating of the nozzle and extrusion plate may be needed to avoid solidifying the melt in or behind the extrusion dies before the viscous semi-solid material has been extruded. Excellent extrusions were obtained using a 3-inch inside diameter, 12-inch long, water-jacketed, Votator brand scraped surface heat exchanger fitted at its outlet with a 3-inch diameter × 6-inch long tubular holding chamber followed by an extrusion nozzle with a plate having 22 holes of 3/16 inch diameter. The extrusion nozzle and plate were cooled by water at about 150°F. Product flow rates between 64 and 120 pounds per hour of surfactant through the apparatus gave good extrusions with this apparatus. Scraper blade velocity was maintained in the range about 2–5 ft. per minute. Cooling water rates were adjusted to maintain outlet temperatures in the range 145°–160°F. Holding time in the holding chamber was in the range about 1 to 3 minutes. The extruded strands were cooled on a conveyor belt in a draft of air having temperature about 45°F. The strands solidified in less than one minute after extrusion. The strands produced by this method are consistently non-tacky dry solids, easily cut or broken by impact to make particles suitable for dry packaging.

It is preferred, but not necessary to solidify the product by this process as the product comes directly from the reactors. Product from the reactor might be solidified and stored, and then later melted and resolidified by the process described before packaging. It is preferred, however, when the product must be stored before solidification, to keep it in melt state until it can be solidified by the process of the invention.

We claim:

1. A method for solidifying a surfactant product mixture which consists essentially of sodium dicyclohexyl sulfosuccinate with about 3–6% by wt. inorganic salts and hydrolysis products and about 13–16% by wt. volatile matter, said process comprising cooling of said product mixture from melt temperature above 175°F. to a lower intermediate temperature in the range from about 145°–165°F. by means of a scraped surface heat exchanger with thorough mixing of the product mixture throughout said cooling step, followed by extrusion of the product mixture at said lower intermediate temperature to form extruded strands of said product and subsequent cooling of said strands to ambient temperature to complete the solidification of the product mixture.

* * * * *